US007029463B1

(12) United States Patent
Estudillo

(10) Patent No.: US 7,029,463 B1
(45) Date of Patent: Apr. 18, 2006

(54) EXPANDABLE VOMIT CONTAINER ASSEMBLY

(76) Inventor: Lura A. Estudillo, 475 Rancho Villa Rd., Vista, CA (US) 92083

( * ) Notice: Subject to any disclaimer, the term of this patent is extended or adjusted under 35 U.S.C. 154(b) by 488 days.

(21) Appl. No.: 10/328,996

(22) Filed: Dec. 26, 2002

(51) Int. Cl.
*A61J 19/00* (2006.01)
*A61J 1/00* (2006.01)

(52) U.S. Cl. ..... 604/317

(58) Field of Classification Search ..... 604/317; 220/495.06, 495.11, 666, 980.1, 8; 4/144.2; 206/218
See application file for complete search history.

(56) References Cited

U.S. PATENT DOCUMENTS

| | | | | | |
|---|---|---|---|---|---|
| 28,597 | A | * | 6/1860 | Niles | 220/8 |
| 991,322 | A | * | 5/1911 | Kimball | 73/429 |
| 2,893,167 | A | * | 7/1959 | Davidson | 47/73 |
| 3,436,928 | A | * | 4/1969 | Swerbinsky | 62/137 |
| D220,204 | S | | 3/1971 | Gahm | |
| 3,961,444 | A | * | 6/1976 | Skaife | 47/79 |
| 4,136,798 | A | | 1/1979 | Oberstein | |
| 4,142,537 | A | * | 3/1979 | Fenelon | 131/242.6 |
| 4,482,116 | A | | 11/1984 | Vadnais | |
| D278,684 | S | * | 5/1985 | Sussman | D9/733 |
| 4,557,378 | A | * | 12/1985 | Klebold | 206/223 |
| 4,610,039 | A | | 9/1986 | Stern | |
| D309,116 | S | * | 7/1990 | Marshall | D10/62 |
| 5,355,789 | A | * | 10/1994 | Suzuki et al. | 100/92 |
| 5,862,932 | A | * | 1/1999 | Walsh et al. | 220/8 |
| 6,070,277 | A | | 6/2000 | Thomas | |
| 6,202,224 | B1 | | 3/2001 | Freeman | |

* cited by examiner

*Primary Examiner*—Tatyana Zalukaeva

(57) ABSTRACT

An expandable vomit container assembly for providing a handy receptacle for a user to vomit into. The expandable vomit container assembly includes a bag support assembly including an expandable bag support member having a base section and a plurality of ring sections, and also including a handle for expanding the expandable bag support member; and also includes a bag being removably disposed in the expandable bag support member; and further includes a bag retainer member for holding the bag to the expandable bag support member.

3 Claims, 3 Drawing Sheets

EXPANDABLE VOMIT CONTAINER ASSEMBLY

BACKGROUND OF THE INVENTION

1. Field of the Invention

The present invention relates to expandable vomit containers and more particularly pertains to a new expandable vomit container assembly for providing a handy receptacle for a user to vomit into.

2. Description of the Prior Art

The use of expandable vomit containers is known in the prior art. More specifically, expandable vomit containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,202,224; U.S. Pat. No. 4,610,039; U.S. Pat. No. 6,070,277; U.S. Pat. No. 4,136,798; U.S. Pat. No. 4,482,116; and U.S. Patent No. Des. 220,204.

While these devices fulfill their respective, particular objectives and requirements, the aforementioned patents do not disclose a new expandable vomit container assembly. The prior art includes accordion-like containers which can be expanded and contracted as needed.

SUMMARY OF THE INVENTION

The general purpose of the present invention, which will be described subsequently in greater detail, is to provide a new expandable vomit container assembly which has many of the advantages of the expandable vomit containers mentioned heretofore and many novel features that result in a new expandable vomit container assembly which is not anticipated, rendered obvious, suggested, or even implied by any of the prior art expandable vomit containers, either alone or in any combination thereof. The present invention includes a bag support assembly including an expandable bag support member having a base section and a plurality of ring sections, and also including a handle for expanding the expandable bag support member; and also includes a bag being removably disposed in the expandable bag support member; and further includes a bag retainer member for holding the bag to the expandable bag support member. None of the prior art includes the combination of the elements of the present invention.

There has thus been outlined, rather broadly, the more important features of the expandable vomit container assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new expandable vomit container assembly which has many of the advantages of the expandable vomit containers mentioned heretofore and many novel features that result in a new expandable vomit container assembly which is not anticipated, rendered obvious, suggested, or even implied by any of the prior art expandable vomit containers, either alone or in any combination thereof.

Still another object of the present invention is to provide a new expandable vomit container assembly for providing a handy receptacle for a user to vomit into.

Still yet another object of the present invention is to provide a new expandable vomit container assembly that is easy and convenient to carry and use.

Even still another object of the present invention is to provide a new expandable vomit container assembly that can be easily concealed and carried on one's person and being readily available upon need.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
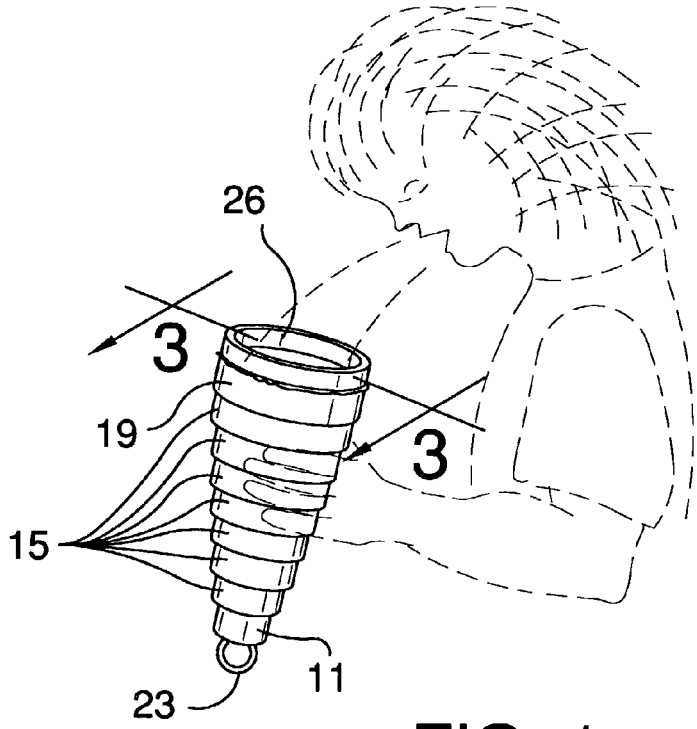
FIG. 1 is a perspective view of a new expandable vomit container assembly according to the present invention.
Figure 4:
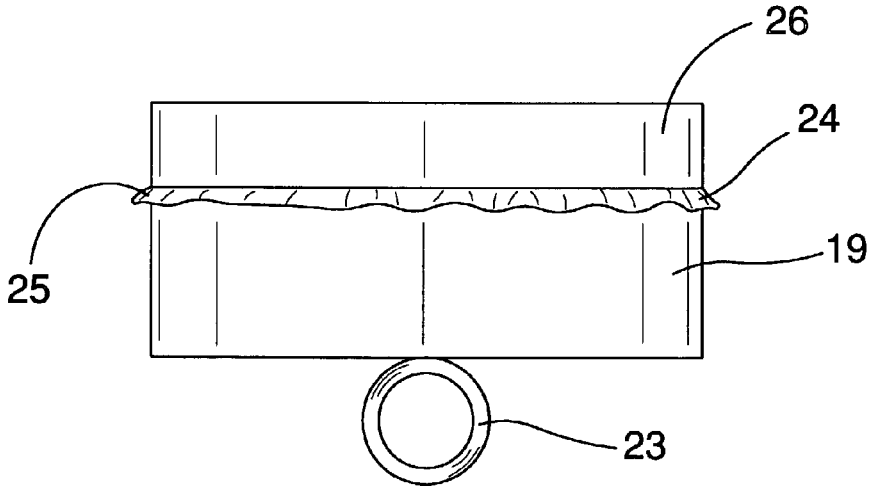
FIG. 4 is a side elevational view of the present invention shown in a compact, retracted position.
Figure 2:
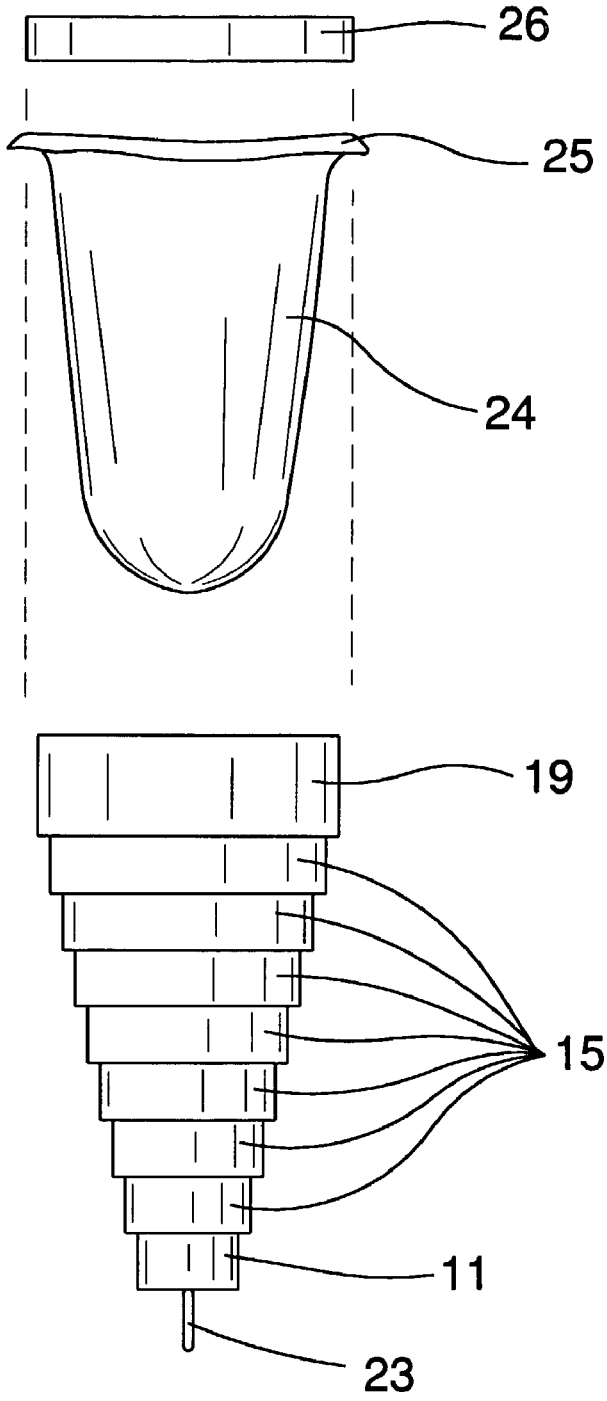
FIG. 2 is an exploded side elevational view of the present invention.
Figure 3:
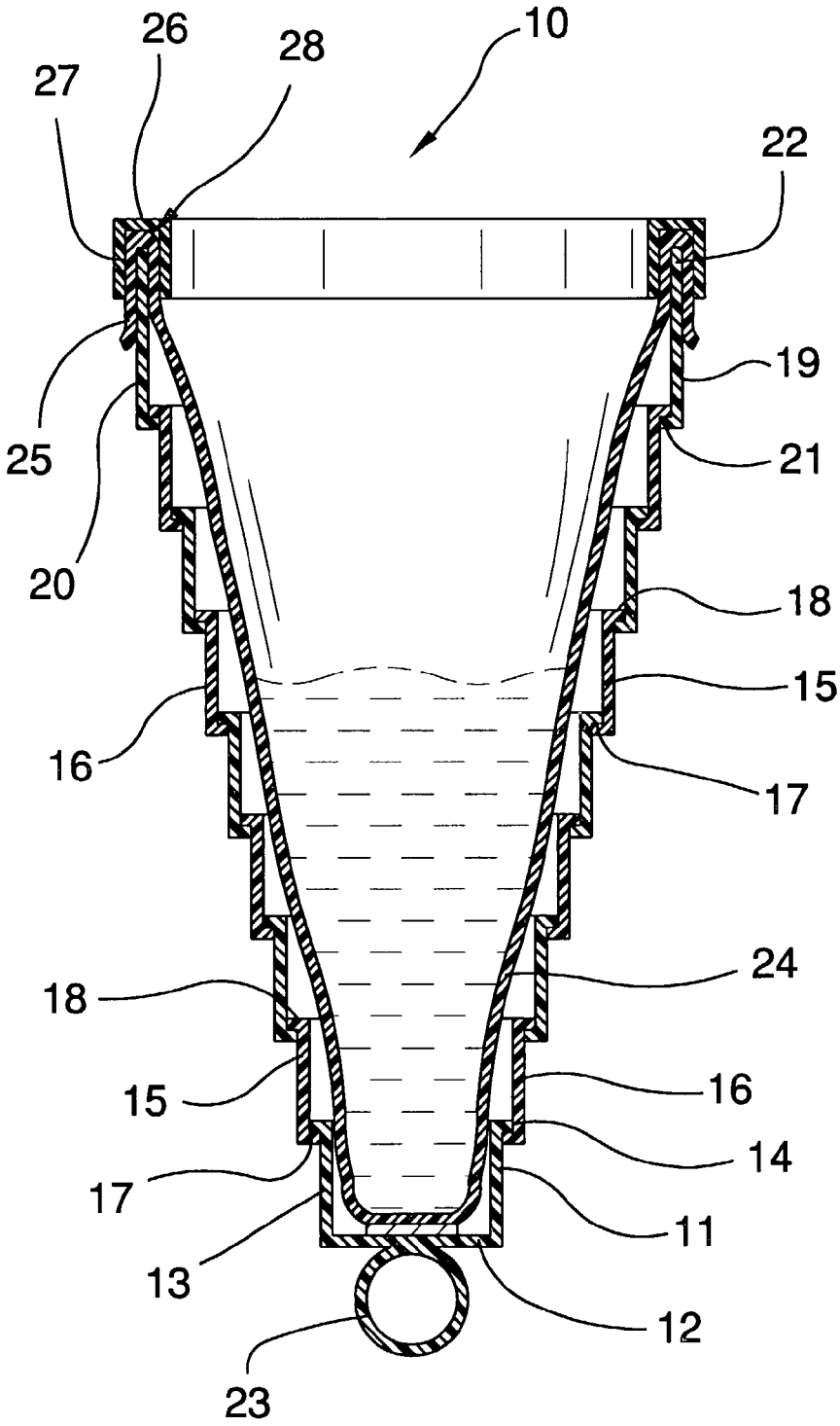
FIG. 3 is a cross-sectional view of the present invention.

With reference now to the drawings, and in particular to FIGS. 1 through 4 thereof, a new expandable vomit container assembly embodying the principles and concepts of the present invention and generally designated by the reference numeral 10 will be described.

As best illustrated in FIGS. 1 through 4, the expandable vomit container assembly 10 generally comprises a bag support assembly including an expandable bag support member having a base section 11 and a plurality of ring sections 15, 19, and also including a handle 23 for expanding the expandable bag support member. The base section 11 is a cup having bottom and side walls 12, 13 and also having an open top and a lip 14 being conventionally disposed about the side wall 13 at the open top of the cup. The ring sections 15, 19 include a plurality of intermediate ring sections 15 each having a side wall 16 and also having an inwardly-disposed flange 17 being conventionally disposed at a bottom end of the side wall 16 and further having an outwardly-disposed flange 18 being conventionally disposed at a top end of the side wall 16 with the inwardly-disposed flange 17 of one of the intermediate ring sections 15 being engageable to the lip 14 of the base section 11, and also include an uppermost ring section 19 having a side wall 20 and an inwardly-disposed flange 21 being conventionally disposed at a bottom end of the side wall 20 thereof. Adjacent intermediate ring sections 15 are connectable one to another with the inwardly-disposed flange 17 of one of the intermediate ring sections 15 being engageable to the outwardly-disposed flange 18 of the other of the intermediate ring sections 15. The inwardly-disposed flange 21 of the uppermost ring section 19 is engageable to the outwardly-disposed flange 18 of one of the intermediate ring sections 15. The intermediate ring sections 15 increase in circumference when moving from the base section 11 to the uppermost ring section 19 upon the expandable bag support member being in an expanded position with the uppermost ring section 19 having a largest circumference and with the base section 11 having a smallest circumference. The base section 11 is retractable in an adjacent intermediate ring section 15 and each of the intermediate ring sections 15 is retractable in an adjacent intermediate ring section 15 when moving from the base section 11 to the uppermost ring section 19 with the base section 11 and the intermediate ring sections 15 being retractable within the uppermost ring section 19. The handle 23 is a grommet being conventionally attached to an outer side of the bottom wall 12 of the base section 11 for a user to grasp to expand the expandable bag support member.

A bag 24 is removably disposed in the expandable bag support member. The bag 24 has a perimeter portion 25 which is removably draped about a top edge 22 of the side wall 20 of the uppermost ring section 19. A bag retainer member 26 for holding the bag 24 to the expandable bag support member is a ring member having a side wall 27 and also having an annular slot 28 being disposed in a bottom edge of the side wall 27 and removably receiving the top edge 22 of the uppermost ring section 19 and the perimeter portion 28 of the bag 27 for holding the bag 27 to the expandable bag support member.

In use, the user grasps the grommet 23 to expand apart the base section and ring sections so that the user can vomit into the bag 24 being held by the bag retainer member 26 in the expandable bag support member. Once used, the user can remove the bag retainer member 26 and remove the bag 24 and place a clean unused bag 24 in the expandable bag support member and hold it in place with the bag retainer member 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the expandable vomit container assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An expandable vomit container assembly comprising:

a bag support assembly including an expandable bag support member having a base section and a plurality of ring sections, and also including a handle for expanding said expandable bag support member, said base section being a cup having bottom and side walls and also having an open top and a lip being disposed about said side wall at said open top of said cup, said ring sections including a plurality of intermediate ring sections each having a side wall and also having an inwardly-disposed flange being disposed at a bottom end of said side wall and further having an outwardly-disposed flange being disposed at a top end of said side wall, said inwardly-disposed flange of one of said intermediate ring sections being engageable to said lip of said base section, and also including an uppermost ring section having a side wall and an inwardly-disposed flange being disposed at a bottom end of said side wall thereof, adjacent said intermediate ring sections being connectable one to another with said inwardly-disposed flange of one of said intermediate ring sections being engageable to said outwardly-disposed flange of the other of said intermediate ring sections, said inwardly-disposed flange of said uppermost ring section being engageable to said outwardly-disposed flange of one of said intermediate ring sections, said intermediate ring sections increasing in circumference when moving from said base section to said uppermost ring section upon said expandable bag support member being expanded with said uppermost ring section having a largest circumference and with said base section having a smallest circumference, said base section being retractable in an adjacent said intermediate ring section and each of said intermediate ring sections being retractable in an adjacent said intermediate ring section when moving from said base section to said uppermost ring section with said base section and said intermediate ring sections being retractable within said uppermost ring section, said handle being a grommet being attached to an outer side of said bottom wall of said base section for a user to grasp to expand said expandable bag support members;

a bag being removably disposed in said expandable bag support member; and a bag retainer member for holding said bag to said expandable bag support member.

2. The expandable vomit container assembly as described in claim 1, wherein said bag has a perimeter portion which is removably draped about a top edge of said side wall of said uppermost ring section.

3. The expandable vomit container assembly as described in claim 2, wherein said bag retainer member is a ring member having a side wall and also having an annular slot being disposed in a bottom edge of said side wall and removably receiving said top edge of said uppermost ring section and said perimeter portion of said bag for holding said bag to said expandable bag support member.

* * * * *